US011555598B1

(12) United States Patent
Tsai et al.

(10) Patent No.: US 11,555,598 B1
(45) Date of Patent: Jan. 17, 2023

(54) CEILING FAN LIGHT KIT AND CEILING FAN CONNECTING MODULE

(71) Applicant: HOTECK INC., Taichung (TW)

(72) Inventors: Kai-Jen Tsai, Taichung (TW); Yu-Ting Ting, Taichung (TW); Chia-Wei Chang, Taichung (TW); Min-Yuan Hsiao, Taichung (TW)

(73) Assignee: HOTECK INC., Taichung (TW)

( * ) Notice: Subject to any disclaimer, the term of this patent is extended or adjusted under 35 U.S.C. 154(b) by 0 days.

(21) Appl. No.: 17/853,177

(22) Filed: Jun. 29, 2022

(51) Int. Cl.

| | |
|---|---|
| ***F21V 19/00*** | (2006.01) |
| ***F04D 25/08*** | (2006.01) |
| ***F21V 33/00*** | (2006.01) |
| ***F21V 29/77*** | (2015.01) |
| ***F04D 29/60*** | (2006.01) |
| ***F04D 25/06*** | (2006.01) |

(52) U.S. Cl.
CPC ..... *F21V 19/0045* (2013.01); *F04D 25/06* (2013.01); *F04D 25/088* (2013.01); *F04D 29/601* (2013.01); *F21V 29/773* (2015.01); *F21V 33/0096* (2013.01)

(58) Field of Classification Search
CPC . F21V 19/0045; F21V 33/0096; F04D 25/088
See application file for complete search history.

(56) References Cited

U.S. PATENT DOCUMENTS

2021/0180614 A1* 6/2021 Botkin ..... F04D 29/646
2021/0231129 A1* 7/2021 Mason ..... F04D 25/088

* cited by examiner

*Primary Examiner* — Karabi Guharay
(74) *Attorney, Agent, or Firm* — Li & Cai Intellectual Property (USA) Office

(57) ABSTRACT

A ceiling fan light kit and a ceiling fan connecting module are provided. The ceiling fan light kit includes the ceiling fan connecting module, a light board, and a light cover module. The ceiling fan connecting module includes a mounting plate and a base. The mounting plate has a plurality of arc holes, a plurality of rotary fixing structures, and a plurality of backstop structures, and a placing hole and a fixing hole are respectively formed at two ends of each of the arc holes. The mounting plate has one of the rotary fixing structures and one of the backstop structures that are spaced apart from one another formed at two sides of each of the arc holes. The base has a bottom plate, a cooling portion, and a plurality of dowels that are respectively disposed in the placing holes.

10 Claims, 8 Drawing Sheets

CEILING FAN LIGHT KIT AND CEILING FAN CONNECTING MODULE

FIELD OF THE DISCLOSURE

The present disclosure relates to a light kit and a connecting module, and more particularly to a ceiling fan light kit and a ceiling fan connecting module.

BACKGROUND OF THE DISCLOSURE

When a conventional ceiling fan light kit is assembled, a plurality of fixing members (such as screws) are often used to assemble various components of a ceiling fan (such as motors and ceiling fan blades) and the ceiling fan light kit together, and the assembled ceiling fan will then be mounted on a ceiling.

However, since the conventional ceiling fan light kits have numerous styles, and the corresponding fixing members have different sizes and quantities, the ceiling fan light kits of different styles cannot be used with components of the same ceiling fan.

In addition, since the ceiling fan light kits of different styles cannot be shared for components of the ceiling fan, the ceiling fan light kit cannot be produced in a modular manner to reduce costs. Therefore, how to overcome the above-mentioned deficiencies through an improvement in structural design has become one of the important issues to be solved in the related art.

SUMMARY OF THE DISCLOSURE

In response to the above-referenced technical inadequacies, the present disclosure provides a ceiling fan light kit and a ceiling fan connecting module.

In one aspect, the present disclosure provides a ceiling fan light kit, and the ceiling fan light kit includes a ceiling fan connecting module, a light board, and a light cover module. The ceiling fan connecting module includes a mounting plate and a base. The mounting plate has a plurality of arc holes, a plurality of rotary fixing structures, and a plurality of backstop structures, and the base has a bottom plate, a cooling portion, and a plurality of dowels. A placing hole and a fixing hole are respectively formed at two ends of each of the arc holes, and the mounting plate has one of the rotary fixing structures and one of the backstop structures that are spaced apart from one another formed at two sides of each of the arc holes along a longitudinal direction of each of the arc holes. The cooling portion is disposed on the bottom plate, and the dowels are formed on the cooling portion. Each of the dowels is disposed in the corresponding placing hole, and each of the dowels has two positions that correspond to the placing hole and the fixing hole and are respectively defined as a mounting position and a fixing position. The base is configured to rotate relative to the mounting plate along a rotational direction, so that each of the dowels is configured to move between the mounting position and the fixing position in the corresponding arc hole and to abut against a surface of the rotary fixing structure or be stopped by the backstop structure. The light board is disposed on a side surface of the bottom plate, and the side surface is arranged away from the mounting plate. The light cover module includes a first cover body, a second cover body, and an accommodating space that is jointly formed by the first cover body and the second cover body, and the light board is disposed in the accommodating space.

In another aspect, the present disclosure provides a ceiling fan connecting module, and the ceiling fan connecting module includes a mounting plate and a base. The mounting plate has a plurality of arc holes, a plurality of rotary fixing structures, and a plurality of backstop structures, and the base has a bottom plate, a cooling portion, and a plurality of dowels. A placing hole and a fixing hole are respectively formed at two ends of each of the arc holes, and the mounting plate has one of the rotary fixing structures and one of the backstop structures that are spaced apart from one another formed at two sides of each of the arc holes along a longitudinal direction of each of the arc holes. The cooling portion is disposed on the bottom plate, and the dowels are formed on the cooling portion. Each of the dowels is disposed in the corresponding placing hole, and each of the dowels has two positions that correspond to the placing hole and the fixing hole and are respectively defined as a mounting position and a fixing position. The base is configured to rotate relative to the mounting plate along a rotational direction, so that each of the dowels is configured to move between the mounting position and the fixing position in the corresponding arc hole and to abut against a surface of the rotary fixing structure or be stopped by the backstop structure.

Therefore, in the ceiling fan light kit and the ceiling fan connecting module provided by the present disclosure, by virtue of "the base being configured to rotate relative to the mounting plate along a rotational direction, so that each of the dowels is configured to move between the mounting position and the fixing position in the corresponding arc hole and to abut against a surface of the rotary fixing structure or be stopped by the backstop structure," the base and the mounting plate can be assembled to each other without additional fixing members (such as screws). Accordingly, an installation speed and a disassembly speed of the ceiling fan light kit and the ceiling fan connecting module can be increased. The structural commonality of a ceiling fan assembled with the ceiling fan connecting module can also be increased, thereby reducing production costs of the ceiling fan light kit.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
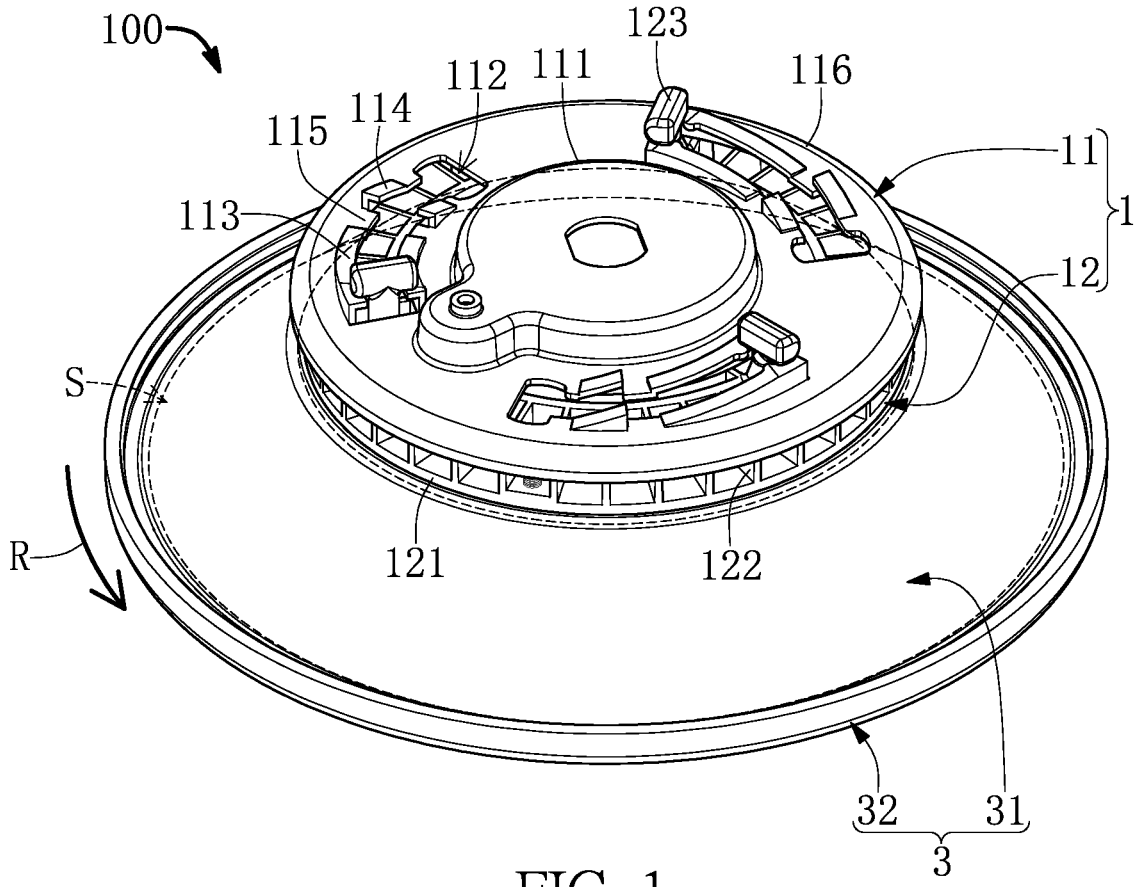
FIG. 1 is a schematic view showing a use state (a) of a ceiling fan light kit according to an embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Figure 2:
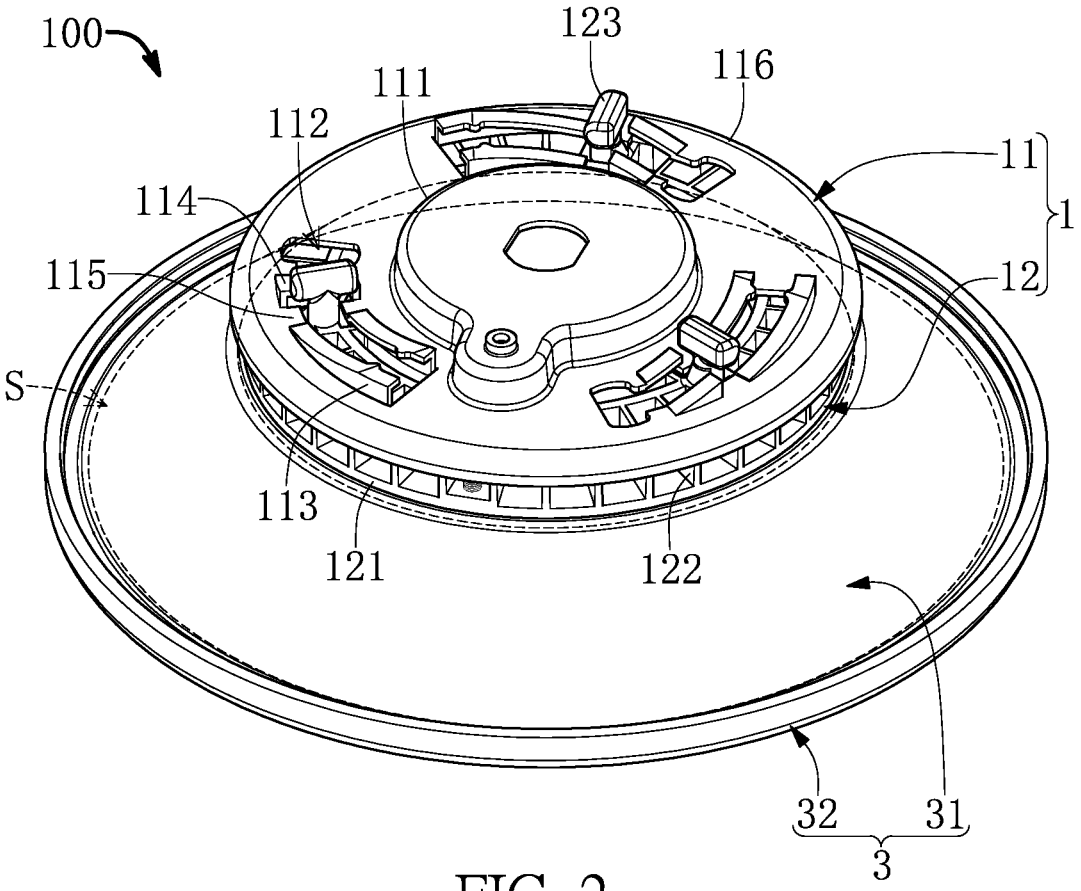
FIG. 2 is a schematic view showing a use state (b) of the ceiling fan light kit according to the embodiment of the present disclosure.

Referring to FIG. 1 to FIG. 8, an embodiment of the present disclosure provides a ceiling fan light kit 100. As shown in FIG. 1 and FIG. 2, the ceiling fan light kit 100 includes a ceiling fan connecting module 1, a light board 2 that is mounted to the ceiling fan connecting module 1, and a light cover module 3 that is mounted to the ceiling fan connecting module 1.

It should be noted that in the present embodiment, the ceiling fan connecting module 1 is described together with the light board 2 and the light cover module 3. However, in other embodiments of the present disclosure, the ceiling fan connecting module 1 can also be independently used (e.g., sold) or used in cooperation with other components.

The ceiling fan connecting module 1 can be used to be mounted to a ceiling fan motor (not shown), the light board 2 can be used to be mounted with a ceiling fan light (not shown), and the ceiling fan light is disposed in the light cover module 3.

Figure 3:
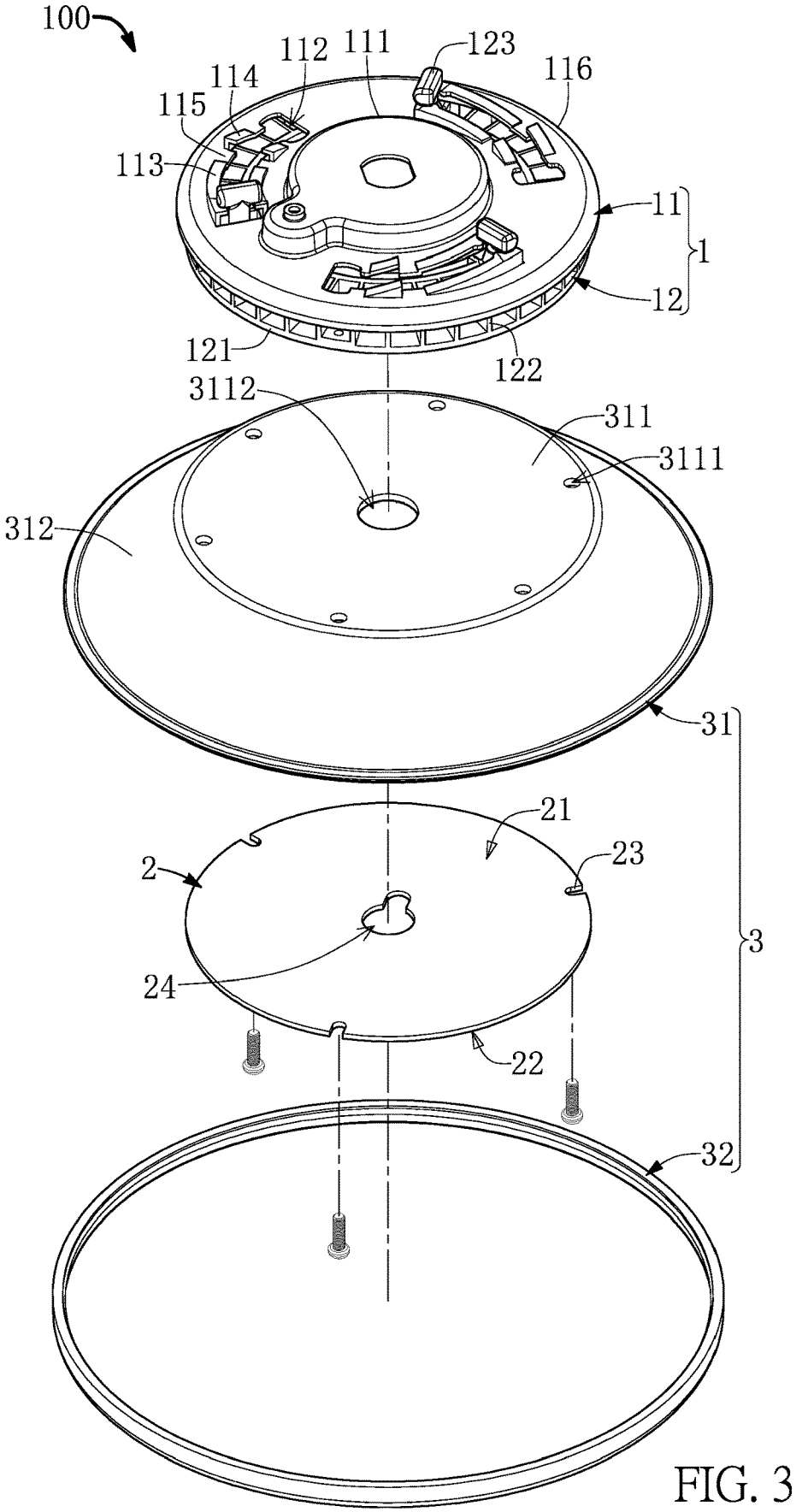
FIG. 3 is an exploded view of the ceiling fan light kit according to the embodiment of the present disclosure.

As shown in FIG. 1 to FIG. 3, the ceiling fan connecting module 1 includes a mounting plate 11 and a base 12 that is mounted to the mounting plate 11, and the mounting plate 11 and the base 12 are both in a circular shape in the present embodiment. In addition, diameters of the mounting plate 11 and the base 12 are not greater than a maximum length of a bottom of the ceiling fan motor, but the present disclosure is not limited thereto. For example, in other embodiments not shown in the present disclosure, the mounting plate 11 and the base 12 can also be in a regular polygon shape or in other geometric shapes, and the diameters of the mounting plate 11 and the base 12 can be greater than the maximum length of the bottom of the ceiling fan motor.

It should be noted that when the mounting plate 11 and the base 12 are in the regular polygon shape, the mounting plate 11 and the base 12 can be picked up and grasped by a user more easily, so that the ceiling fan connecting module 1 has a foolproof function during installation.

As shown in FIG. 1 to FIG. 3, the mounting plate 11 has a mounting portion 111 that is adjacent to a central position of the mounting plate 11, a plurality of arc holes 112 that are adjacent to and surrounds the mounting portion 111, a plurality of rotary fixing structures 113 that are adjacent to the arc holes 112, a plurality of backstop structures 114, a plurality of limiting structures 115, and a snapping portion 116 that is surroundingly formed at an edge of the mounting plate 11.

Figure 4:
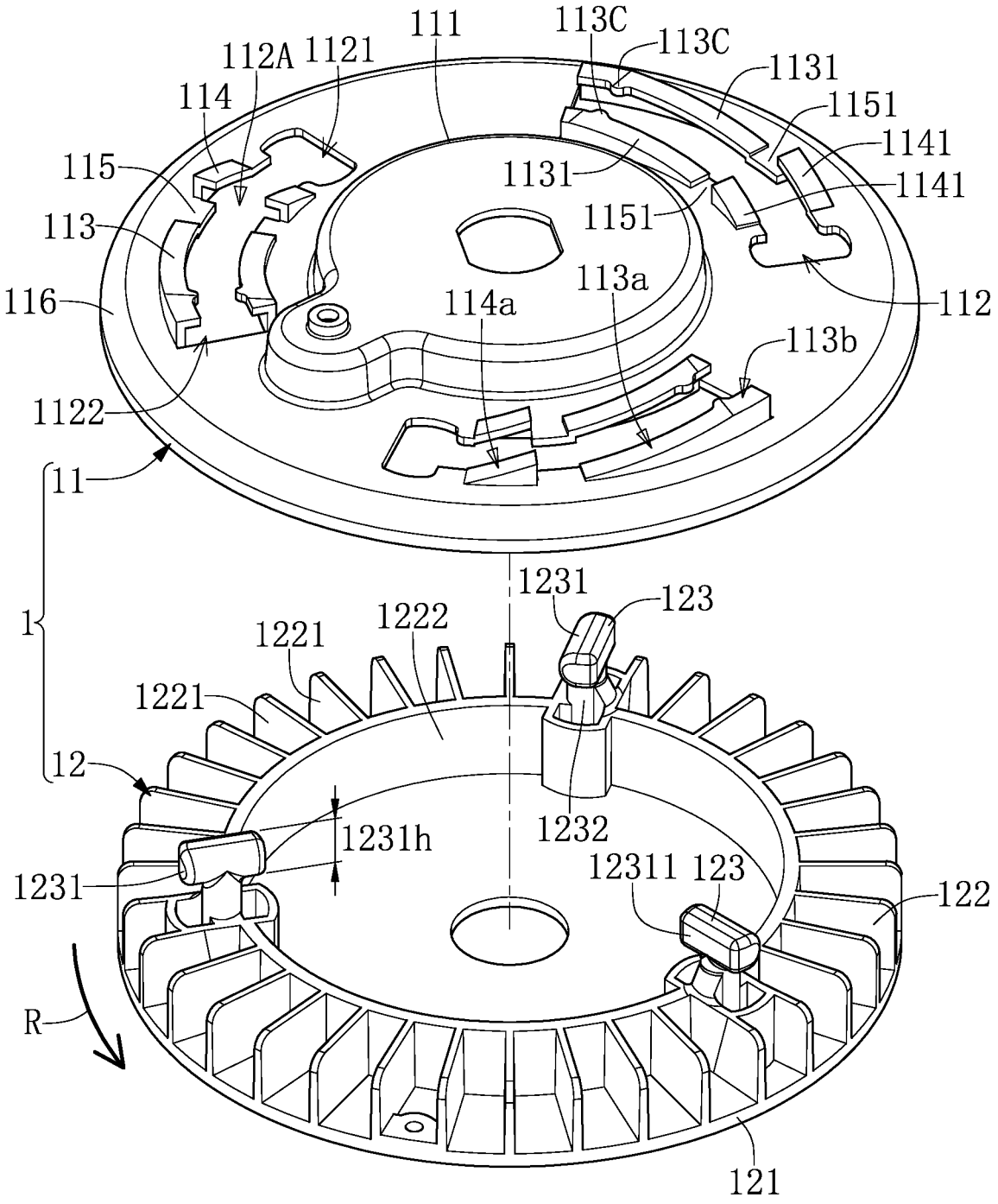
FIG. 4 is an exploded view of a ceiling fan connecting module according to the embodiment of the present disclosure.

In addition, the mounting plate 11 has a side surface that is arranged away from the base 12 and coplanar with a surface of each of the arc holes 112. As shown in FIG. 4, the surface of each of the arc holes 112 is defined as an arc hole surface 112A.

As shown in FIG. 4, a placing hole 1121 and a fixing hole 1122 are respectively formed at two ends of each of the arc holes 112. The mounting plate 11 has one of the rotary fixing structures 113, one of the backstop structures 114, and one of the limiting structures 115 that are spaced apart from one another formed at two sides of each of the arc holes 112 along a longitudinal direction (not shown) of each of the arc holes 112. The limiting structure 115 is located between the rotary fixing structure 113 and the backstop structure 114. In addition, in the present embodiment, the longitudinal direction is not a straight line, but is in an arc shape.

More specifically, each of the rotary fixing structures 113 has two rotary fixing plates 1131 that are in a mirror symmetry, each of the backstop structures 114 has two backstop plates 1141 that are in a mirror symmetry, and each of the limiting structures 115 has two limiting plates 1151 that are in a mirror symmetry.

In addition, cross sections of each of the two rotary fixing plates 1131 and each of the two backstop plates 1141 are L-shaped, and each of the two limiting plates 1151 is a flat plate, but the present disclosure is not limited thereto. For example, in other embodiments not shown in the present disclosure, the shapes of each of the two rotary fixing plates 1131, each of the backstop plates 1141, and each of the limiting plates 1151 can be adjusted according to practical requirements.

It should be noted that, in the present embodiment (as shown in FIG. 4), the two rotary fixing plates 1131, the two backstop plates 1141, and the two limiting plates 1151 are formed at the two sides of each of the arc holes 112 along the longitudinal direction (not shown) of each of the arc holes 112. More specifically, one of the two rotary fixing plates 1131, one of the two backstop plates 1141, and one of the two limiting plates 1151 are formed at one of the two sides of each of the arc holes 112 along the longitudinal direction of each of the arc holes 112, and another one of the two rotary fixing plates 1131, another one of the two backstop plates 1141, and another one of the two limiting plates 1151 are formed at another one of the two sides of each of the arc holes 112 along the longitudinal direction of each of the arc holes 112.

Furthermore, relative to the arc hole surface 112A, each of the rotary fixing structures 113 and each of the backstop structures 114 respectively have a first inclined surface 113*a* and a second inclined surface 114*a*. An edge of the first inclined surface 113*a* that is adjacent to the backstop structure 114 is connected to an edge of one of the limiting plates 1151 that corresponds in position to the first inclined surface 113*a*. In addition, an edge of the second inclined surface 114*a* is aligned with the edge of the one of the limiting plates 1151.

Figure 5:
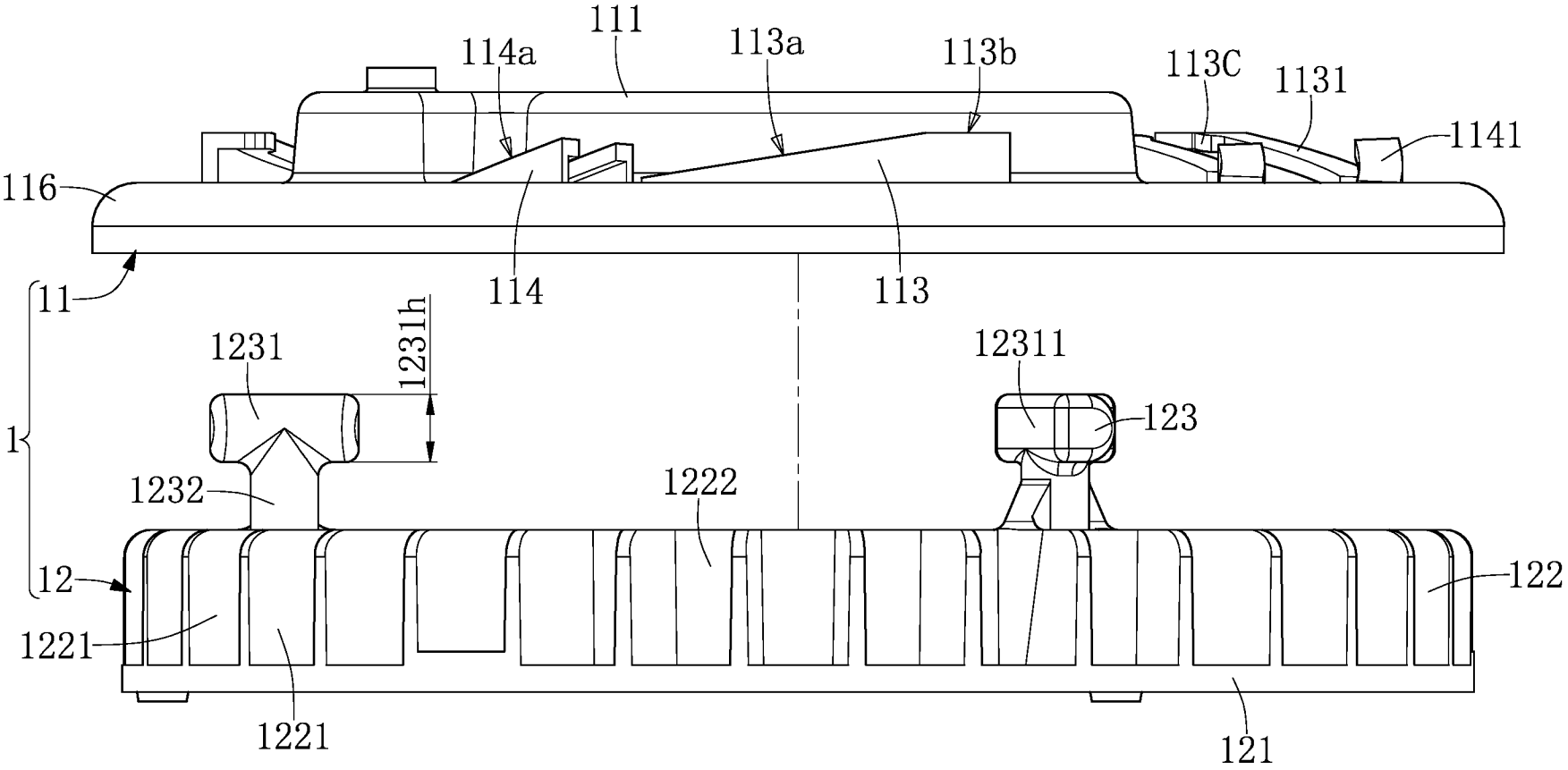
FIG. 5 is a side view of a rotary fixing structure and a backstop structure according to the embodiment of the present disclosure.

More specifically, as shown in FIG. 5, the first inclined surface 113*a* and the arc hole surface 112A have a maximum vertical distance there-between, and the second inclined surface 114*a* and the arc hole surface 112A have a maximum vertical distance there-between. The maximum vertical distance between the first inclined surface 113*a* and the arc hole surface 112A is the same as the maximum vertical distance between the second inclined surface 114*a* and the arc hole surface 112A, or a slight deviation can exist between these two maximum vertical distances.

In addition, a projection area formed by an orthographic projection of the first inclined surface 113*a* on the arc hole surface 112A has a first length (not labeled), a projection area formed by an orthographic projection of the second inclined surface 114*a* on the arc hole surface 112A has a second length (not labeled), and the first length is greater than the second length.

In other words, in the present embodiment, a tangent value of the first inclined surface 113*a* that is relative to the arc hole surface 112A is less than a tangent value of the second inclined surface 114*a* that is relative to the arc hole surface 112A.

Furthermore, as shown in FIG. 1, FIG. 2, FIG. 6, and FIG. 7, each of the rotary fixing structures 113 extends from an edge of the first inclined surface 113*a* to form an abutting surface 113*b*, and the edge of the first inclined surface 113*a* is arranged away from the second inclined surface 114*a*. A normal vector of the abutting surface 113*b* and a normal vector of the arc hole surface 112A that corresponds in position to the abutting surface 113*b* are parallel to or staggered with each other.

Figure 6:
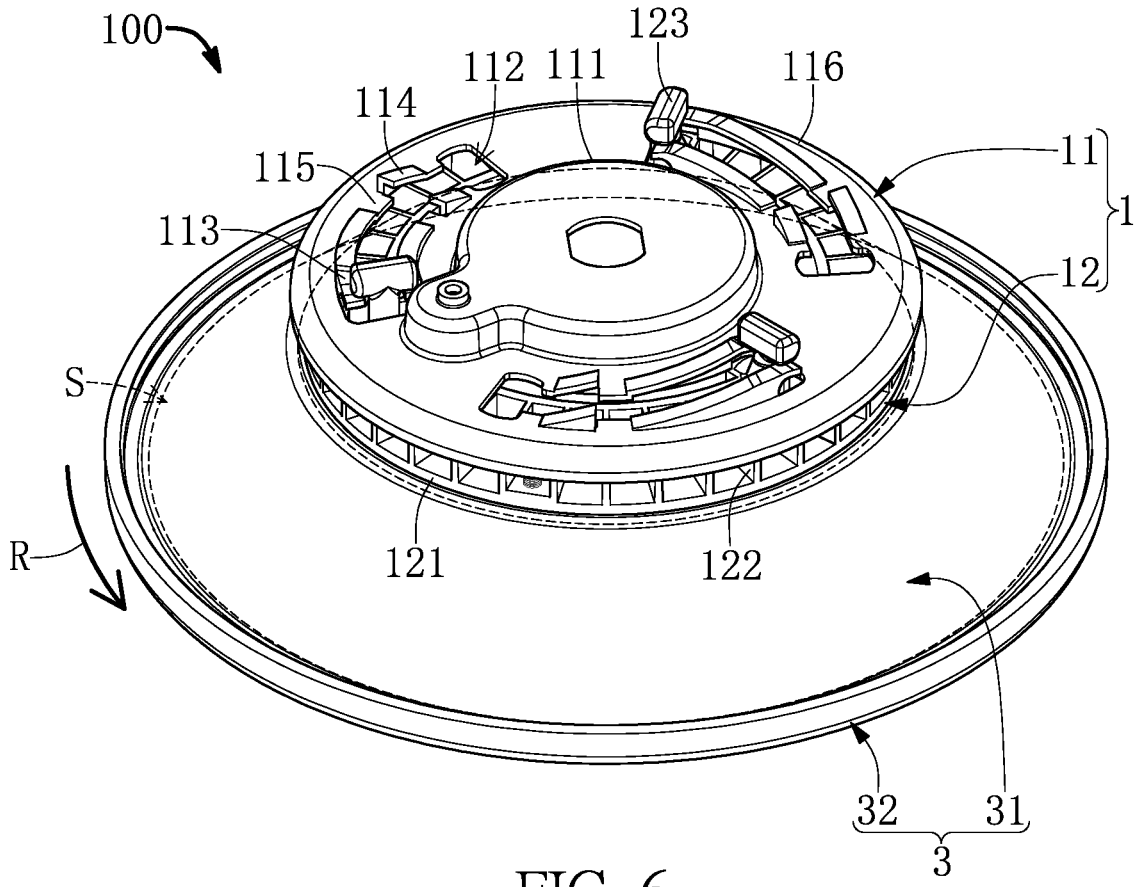
FIG. 6 is a schematic view showing a use state (c) of the ceiling fan light kit according to the embodiment of the present disclosure.
Figure 7:
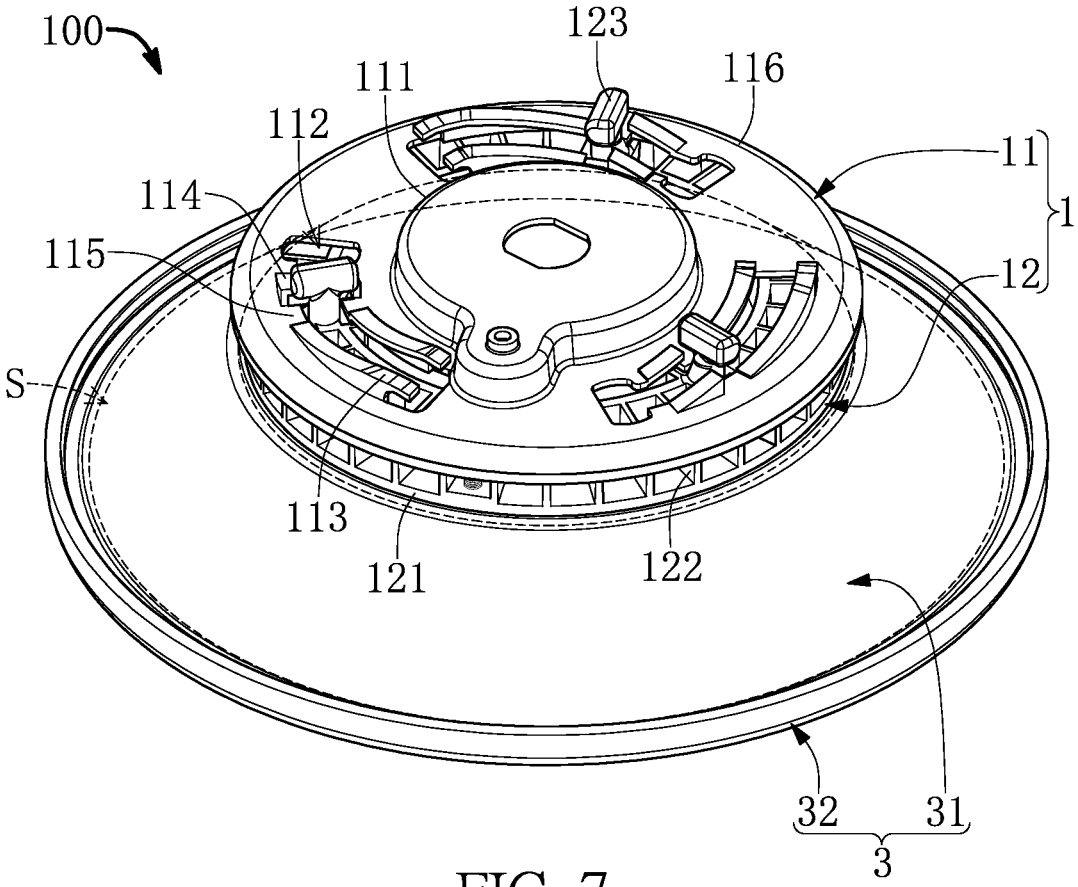
FIG. 7 is a schematic view showing a use state (d) of the ceiling fan light kit according to the embodiment of the present disclosure.
Figure 8:
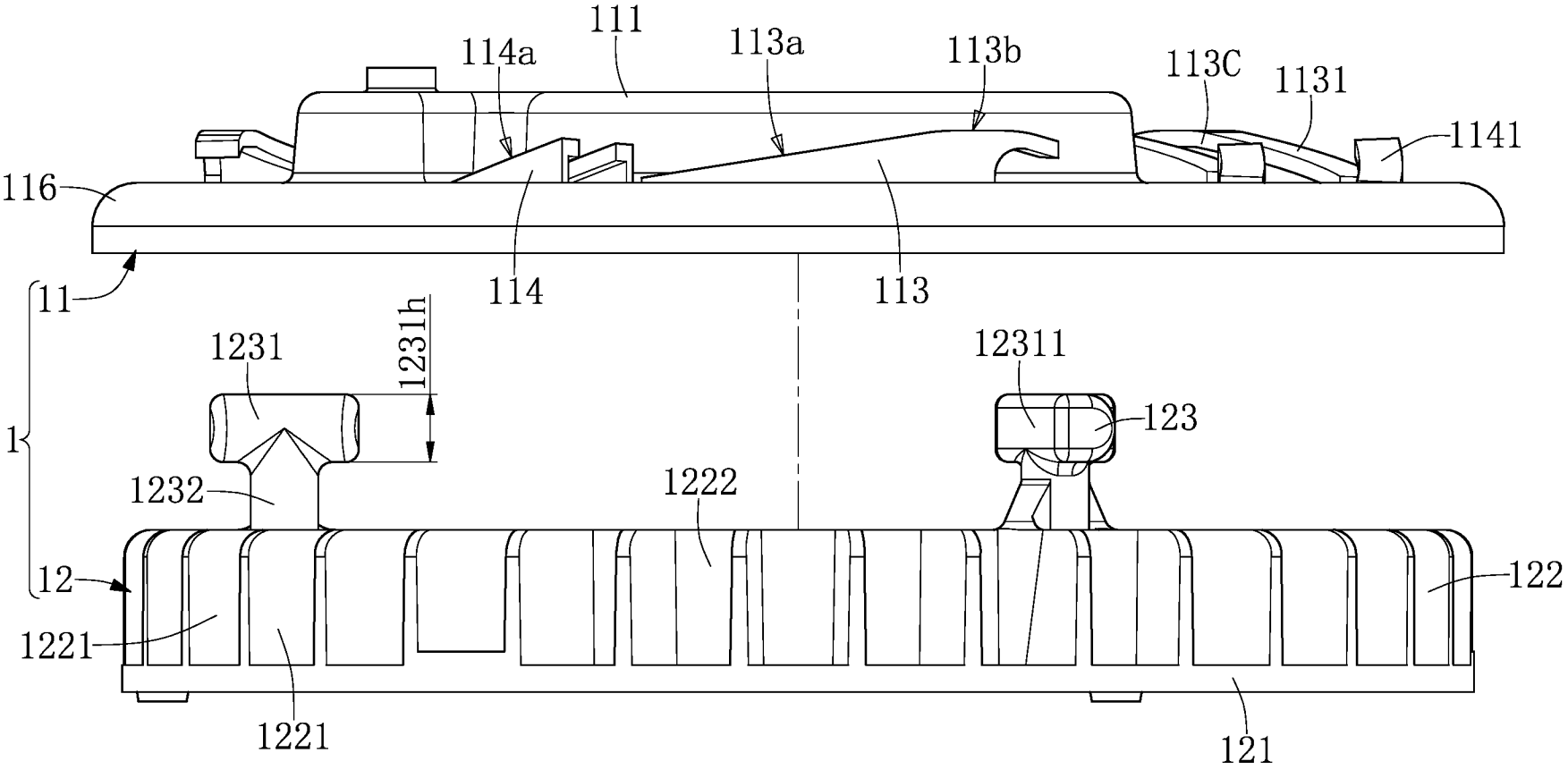
FIG. 8 is another side view of the rotary fixing structure and the backstop structure according to the embodiment of the present disclosure.

In addition, as shown in FIG. 1, FIG. 2, and FIG. 5, when the above-mentioned two normal vectors are parallel to each other, the abutting surface 113*b* is parallel to the mounting plate 11. As shown in FIG. 6 to FIG. 8, when the above-mentioned two normal vectors are staggered with each other, the abutting surface 113*b* is formed from the first inclined surface 113*a* and extends toward the mounting plate 11.

It should be noted that, as shown in FIG. 4, a protruding block 113*c* is formed at a side of each of the rotary fixing plates 1131, and the side of each of the rotary fixing plates 1131 is adjacent to a central axis of the arc hole 112 that corresponds thereto. A minimum vertical distance is defined between the protruding block 113*c* and an edge of the arc hole 112 that corresponds thereto, and the minimum vertical distance is not greater than ⅛ of a width of each of the arc holes 112, but the present disclosure is not limited thereto. For example, in other embodiments of the present disclosure, each of the rotary fixing plates 1131 can also be provided without the protruding block 113*c*.

As shown in FIG. 1 to FIG. 3, the snapping portion 116 is snapped onto the base 12. The snapping portion 116 is used to increase an installation speed of the mounting plate 11 and the base 12, and to prevent the mounting plate 11 and the base 12 from being easily separated from each other.

As shown in FIG. 2 to FIG. 3, the base 12 has a bottom plate 121, a cooling portion 122 that is disposed on the bottom plate 121, and a plurality of dowels 123 that are formed on the cooling portion 122, and each of the dowels 123 is disposed in the corresponding placing hole 1121. In addition, each of the dowels 123 has two positions that correspond to the placing hole 1121 and the fixing hole 1122, and are respectively defined as a mounting position (not labeled) and a fixing position (not labeled).

The cooling portion 122 includes a plurality of cooling fins 1221 and a surrounding wall 1222 that is connected to the cooling fins 1221, and a height of each of the cooling fins 1221 is the same as a height of the surrounding wall 1222. In addition, as shown in FIG. 3, the mounting plate 11 is detachably disposed on the cooling portion 122, and the mounting plate 11 preferably abuts against the cooling fins 1221. In this way, a cooling function of the mounting plate 11 can be effectively increased.

Furthermore, each of the dowels 123 includes a dowel head 1231 and a dowel pillar 1232 that is connected to the dowel head 1231, and the dowel head 1231 has a plane portion 12311 that has a dowel head height 1231*h*. The dowel head height 1231*h* is not greater than a shortest vertical distance between the edge of the second inclined surface 114*a* and the arc hole surface 112A. Accordingly, when the dowel head 1231 is located on the limiting structure 115, the dowel head 1231 can be stopped by the backstop structure 114 due to the plane portion 12311.

In addition, the dowel head 1231 has a side surface (not labeled) that is adjacent to the dowel pillar 1232, a minimum vertical distance is defined between the side surface of the dowel head 1231 and the arc hole surface 112A, and the minimum vertical distance is not greater than a shortest vertical distance between any point of the abutting surface 113*b* and the arc hole surface 112A. Accordingly, the dowel head 1231 can be firmly fixed on the abutting surface 113*b*.

It should be noted that in the present embodiment, the number of the dowels 123 is preferably not less than three, and the dowel pillar 1232 of each of the dowels 123 is integrally formed on the bottom plate 121.

As mentioned above, the base 12 is configured to rotate relative to the mounting plate 11 along a rotational direction R, so that each of the dowels 123 is configured to move between the mounting position and the fixing position in the corresponding arc hole 112 and to abut against a surface of the rotary fixing structure 113 with the dowel head 1231 or be stopped by the backstop structure 114 due to the plane portion 12311.

Accordingly, without additional fixing members (such as screws), the base 12 and the mounting plate 11 of the ceiling fan connecting module 1 can be assembled to each other, such that an installation speed and a disassembly speed of the ceiling fan connecting module 1 can be effectively increased.

As shown in FIG. 3, the light board 2 is disposed on a side surface of the bottom plate 121, and the side surface is arranged away from the mounting plate 11. The light board 2 includes a bottom surface 21, a cooling surface 22 that corresponds in position to the bottom surface 21, a plurality of recessed portions 23 that are formed at an outer edge of the light board 2, and a first mounting hole 24 that is formed adjacent to a central position of the light board 2.

As shown in FIG. 1 and FIG. 2, the light cover module 3 includes a first cover body 31, a second cover body 32 that is detachably fixed to the first cover body 31, and an accommodating space S that is jointly formed by the first cover body 31 and the second cover body 32. In addition, as shown in FIG. 3, the light board 2 is disposed in the accommodating space S and is adjacent to the bottom plate 121.

More specifically, the first cover body 31 has a top cover 311 and a surrounding cover 312 that is surroundingly formed from the top cover 311. An edge of the surrounding cover 312 is distant away from the top cover 311, and is engaged with an edge of the second cover body 32, so that the accommodating space S is jointly formed by the first cover body 31 and the second cover body 32. In addition, the top cover 311 includes a plurality of screwing holes 3111 that are adjacent to an edge of the top cover 311 and a second mounting hole 3112 that is adjacent to a central position of the top cover 311.

Beneficial Effects of the Embodiments

In conclusion, in the ceiling fan light kit 100 and the ceiling fan connecting module 1 provided by the present disclosure, by virtue of "the base 12 being configured to rotate relative to the mounting plate 11 along a rotational direction R, so that each of the dowels 123 is configured to move between the mounting position and the fixing position in the corresponding arc hole 112 and to abut against a surface of the rotary fixing structure 113 or be stopped by the backstop structure 114," the base 12 and the mounting plate 11 can be assembled to each other without additional fixing members (such as screws). Accordingly, the installation speed and the disassembly speed of the ceiling fan light kit 100 and the ceiling fan connecting module 1 can be increased. The structural commonality of a ceiling fan assembled with the ceiling fan connecting module 1 can also be increased, thereby reducing production costs of the ceiling fan light kit 100.

Furthermore, by virtue of "each of the rotary fixing structures 113 extending from an edge of the first inclined surface 113*a* to form an abutting surface 113*b*, the edge of the first inclined surface 113*a* being arranged away from the second inclined surface 114*a*, and a normal vector of the abutting surface 113*b* and a normal vector of the arc hole surface 112A that corresponds in position to the abutting surface 113*b* being parallel to or staggered with each other," the dowel 123 can be firmly fixed on the rotary fixing structure 113 when the dowel 123 abuts against the two first inclined surfaces 113*a*.

Furthermore, by virtue of "the mounting plate 11 having a side surface that is arranged away from the base 12 and coplanar with a surface of each of the arc holes 112, the surface of each of the arc holes 112 being defined as an arc hole surface 112A, and relative to the arc hole surface 112A, each of the two rotary fixing plates 1131 and each of the two backstop plates 1141 respectively having a first inclined surface 113*a* and a second inclined surface 114*a*," the user can clearly determine whether or not the base 12 and the mounting plate 11 are screwed to each other through a tactile sensation when rotating the base 12 or the mounting plate 11.

Furthermore, by virtue of "a tangent value of the first inclined surface 113*a* that is relative to the arc hole surface 112A being less than a tangent value of the second inclined surface 114*a* that is relative to the arc hole surface 112A," the dowel 123 can have a sufficient movement distance when the dowel 123 abuts against the two first inclined surfaces 113*a* and moves toward the abutting surface 113*b*.

Furthermore, by virtue of "a protruding block 113*c* being formed at a side of each of the rotary fixing plates 1131, the side of each of the rotary fixing plates 1131 being adjacent to a central axis of the arc hole 112 that corresponds thereto, a minimum vertical distance being defined between the protruding block 113*c* and an edge of the arc hole 112 that corresponds thereto, and the minimum vertical distance being not greater than ⅛ of a width of each of the arc holes 112," the dowel 123 does not easily depart from the abutting surface 113*b* due to shaking or other external factors, but is first restricted by the protruding block 113*c*.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A ceiling fan light kit, comprising:

a ceiling fan connecting module including:

a mounting plate having a plurality of arc holes, a plurality of rotary fixing structures, and a plurality of backstop structures, wherein a placing hole and a fixing hole are respectively formed at two ends of each of the arc holes, and the mounting plate has one of the rotary fixing structures and one of the backstop structures that are spaced apart from one another formed at two sides of each of the arc holes along a longitudinal direction of each of the arc holes; and a base having a bottom plate, a cooling portion that is disposed on the bottom plate, and a plurality of dowels that are formed on the cooling portion, wherein each of the dowels is disposed in the corresponding placing hole, and each of the dowels has two positions that correspond to the placing hole and the fixing hole and are respectively defined as a mounting position and a fixing position;

wherein the base is configured to rotate relative to the mounting plate along a rotational direction, so that each of the dowels is configured to move between the mounting position and the fixing position in the corresponding arc hole and to abut against a surface of the rotary fixing structure or be stopped by the backstop structure;

a light board disposed on a side surface of the bottom plate, wherein the side surface is arranged away from the mounting plate; and a light cover module including a first cover body, a second cover body, and an accommodating space that is jointly formed by the first cover body and the second cover body, wherein the light board is disposed in the accommodating space.

2. The ceiling fan light kit according to claim 1, wherein each of the rotary fixing structure has two rotary fixing plates that are in a mirror symmetry, each of the backstop structures has two backstop plates that are in a mirror symmetry, and cross sections of each of the two rotary fixing plates and each of the two backstop plates are L-shaped.

3. The ceiling fan light kit according to claim 2, wherein the mounting plate has a side surface that is arranged away from the base and coplanar with a surface of each of the arc holes, and the surface of each of the arc holes is defined as an arc hole surface, and wherein, relative to the arc hole surface, each of the two rotary fixing plates and each of the two backstop plates respectively have a first inclined surface and a second inclined surface.

4. The ceiling fan light kit according to claim 3, wherein a tangent value of the first inclined surface that is relative to the arc hole surface is less than a tangent value of the second inclined surface that is relative to the arc hole surface.

5. The ceiling fan light kit according to claim 3, wherein a limiting structure is formed at two long sides of each of the arc holes on the mounting plate, the limiting structure is located between the rotary fixing structure and the backstop structure, and the limiting structure includes two limiting plates, and wherein the first inclined surface is connected to an edge of one of the limiting plates that corresponds in position to the first inclined surface at a side surface of any one of the arc holes, and an edge of the second inclined surface is aligned with the edge of the one of the limiting plates.

6. The ceiling fan light kit according to claim 3, wherein each of the two rotary fixing plates extends from an edge of the first inclined surface to form an abutting surface, and the edge of the first inclined surface is arranged away from the second inclined surface, and wherein a normal vector of the abutting surface and a normal vector of the arc hole surface that corresponds in position to the abutting surface are parallel to or staggered with each other.

7. The ceiling fan light kit according to claim 6, wherein each of the dowels includes a dowel head and a dowel pillar that is connected to the dowel head, and the dowel head has a side surface that is adjacent to the dowel pillar, and wherein a minimum vertical distance is defined between the side surface of the dowel head and the arc hole surface, and the minimum vertical distance is not greater than a shortest vertical distance between any point of the abutting surface and the arc hole surface.

8. The ceiling fan light kit according to claim 7, wherein the dowel includes a plane portion having a dowel head height that is not greater than a shortest vertical distance between an edge of the second inclined surface and the arc hole surface.

9. The ceiling fan light kit according to claim 3, wherein a protruding block is formed at a side of each of the two rotary fixing plates, and the side of each of the two rotary fixing plates is adjacent to a central axis of the arc hole that corresponds thereto, and wherein a minimum vertical distance is defined between the protruding block and an edge of the arc hole that corresponds thereto, and the minimum vertical distance is not greater than ⅛ of a width of each of the arc holes.

10. A ceiling fan connecting module, comprising:

a mounting plate having a plurality of arc holes, a plurality of rotary fixing structures, and a plurality of backstop structures, wherein a placing hole and a fixing hole are respectively formed at two ends of each of the arc holes, and the mounting plate has one of the rotary fixing structures and one of the backstop structures that are spaced apart from one another formed at two sides of each of the arc holes along a longitudinal direction of each of the arc holes; and a base having a bottom plate, a cooling portion that is disposed on the bottom plate, and a plurality of dowels that are formed on the cooling portion, wherein each of the dowels is disposed in the corresponding placing hole, and each of the dowels has two positions that correspond to the placing hole and the fixing hole and are respectively defined as a mounting position and a fixing position;

wherein the base is configured to rotate relative to the mounting plate along a rotational direction, so that each of the dowels is configured to move between the mounting position and the fixing position in the corresponding arc hole and to abut against a surface of the rotary fixing structure or be stopped by the backstop structure.

* * * * *